US008962092B2

(12) United States Patent
Trksak et al.

(10) Patent No.: US 8,962,092 B2
(45) Date of Patent: Feb. 24, 2015

(54) PAPER SIZING USING AN AGENT CONTAINING UNIFORMLY BOUND OCTENYL SUCCINIC ANHYDRIDE GROUPS MADE BY THE REACTION OF OCTENYL SUCCINIC ANHYDRIDE ONTO A DISPERSED WAXY STARCH

(71) Applicants: Ralph Trksak, Manville, NJ (US); Non Kam Foong, Singapore (SG)

(72) Inventors: Ralph Trksak, Manville, NJ (US); Non Kam Foong, Singapore (SG)

(73) Assignee: Corn Products Development, Inc., Sao Paulo (BR)

( * ) Notice: Subject to any disclaimer, the term of this patent is extended or adjusted under 35 U.S.C. 154(b) by 0 days.

(21) Appl. No.: 13/753,881

(22) Filed: Jan. 30, 2013

(65) Prior Publication Data

US 2014/0212589 A1 Jul. 31, 2014

(51) Int. Cl.

| | |
|---|---|
| ***B05D 5/00*** | (2006.01) |
| ***D21H 21/16*** | (2006.01) |
| ***D21H 17/17*** | (2006.01) |
| ***D21H 17/28*** | (2006.01) |
| ***D21H 19/54*** | (2006.01) |

(52) U.S. Cl.

CPC ..... *D21H 21/16* (2013.01); *D21H 17/17* (2013.01); *D21H 17/28* (2013.01); *D21H 19/54* (2013.01)

USPC ..... 427/395; 427/391

(58) Field of Classification Search

None

See application file for complete search history.

(56) References Cited

U.S. PATENT DOCUMENTS

| | | | | |
|---|---|---|---|---|
| 4,040,900 | A * | 8/1977 | Mazzarella et al. | 162/158 |
| 4,239,592 | A * | 12/1980 | Gaspar et al. | 162/175 |
| 4,721,655 | A * | 1/1988 | Trzasko et al. | 428/530 |
| 4,872,951 | A * | 10/1989 | Maliczyszyn et al. | 162/135 |
| 6,372,361 | B1 * | 4/2002 | Mackewicz et al. | 428/537.5 |
| 6,447,615 | B2 | 9/2002 | Hanchett et al. | |
| 6,521,088 | B1 * | 2/2003 | Richardson et al. | 162/175 |
| 8,252,322 | B2 | 8/2012 | Trubiano et al. | |
| 2007/0224324 | A1 * | 9/2007 | Debon et al. | 426/550 |
| 2010/0209725 | A1 * | 8/2010 | Kataja et al. | 428/533 |
| 2011/0124746 | A1 | 5/2011 | Trksak et al. | |

* cited by examiner

*Primary Examiner* — Erma Cameron

(74) *Attorney, Agent, or Firm* — John Daniel Wood

(57) ABSTRACT

The application relates to an agent containing bound octenyl succinic anhydride groups made via the reaction of octenyl succinic anhydride onto a dispersed waxy starch, which provides significant improvements in paper porosity reduction, when added at a low level to a commodity surface starch dispersion and used to surface size paper.

13 Claims, 5 Drawing Sheets

PAPER SIZING USING AN AGENT CONTAINING UNIFORMLY BOUND OCTENYL SUCCINIC ANHYDRIDE GROUPS MADE BY THE REACTION OF OCTENYL SUCCINIC ANHYDRIDE ONTO A DISPERSED WAXY STARCH

Paper sizing improves the surface strength, printability, and water resistance of the paper or material to which the sizing is applied. Sizing is used during paper manufacture to reduce the paper's tendency when dry to absorb liquid. Sizing has the goal of allowing inks and paints to remain on the surface of the paper and to dry there, rather than be absorbed into the paper. This provides a more consistent, economical, and precise printing, painting, or writing surface. Sizing limits the paper fibers' tendency to absorb liquids by capillary action. In addition, sizing affects abrasiveness, creasability, finish, printability, smoothness, and surface bond strength and sizing decreases surface porosity and fuzzing.

SUMMARY

In one aspect the application provides a process comprising:

a) slurrying a waxy starch and gelatinizing the slurry to a starch dispersion;
b) optionally cooling the starch dispersion;
c) optionally acidifying the optionally cooled starch dispersion and waiting until the optionally acidified starch dispersion reaches a funnel viscosity of from about 20 seconds to about 30 seconds;
d) reacting the optionally acidified starch dispersion from step c) with octenylsuccinic anhydride to prepare a reacted starch dispersion;
e) mixing the reacted starch dispersion with converted starch to prepare a starch mixture; and
f) applying the starch mixture to paper.

DETAILED DESCRIPTION

Figure 1:
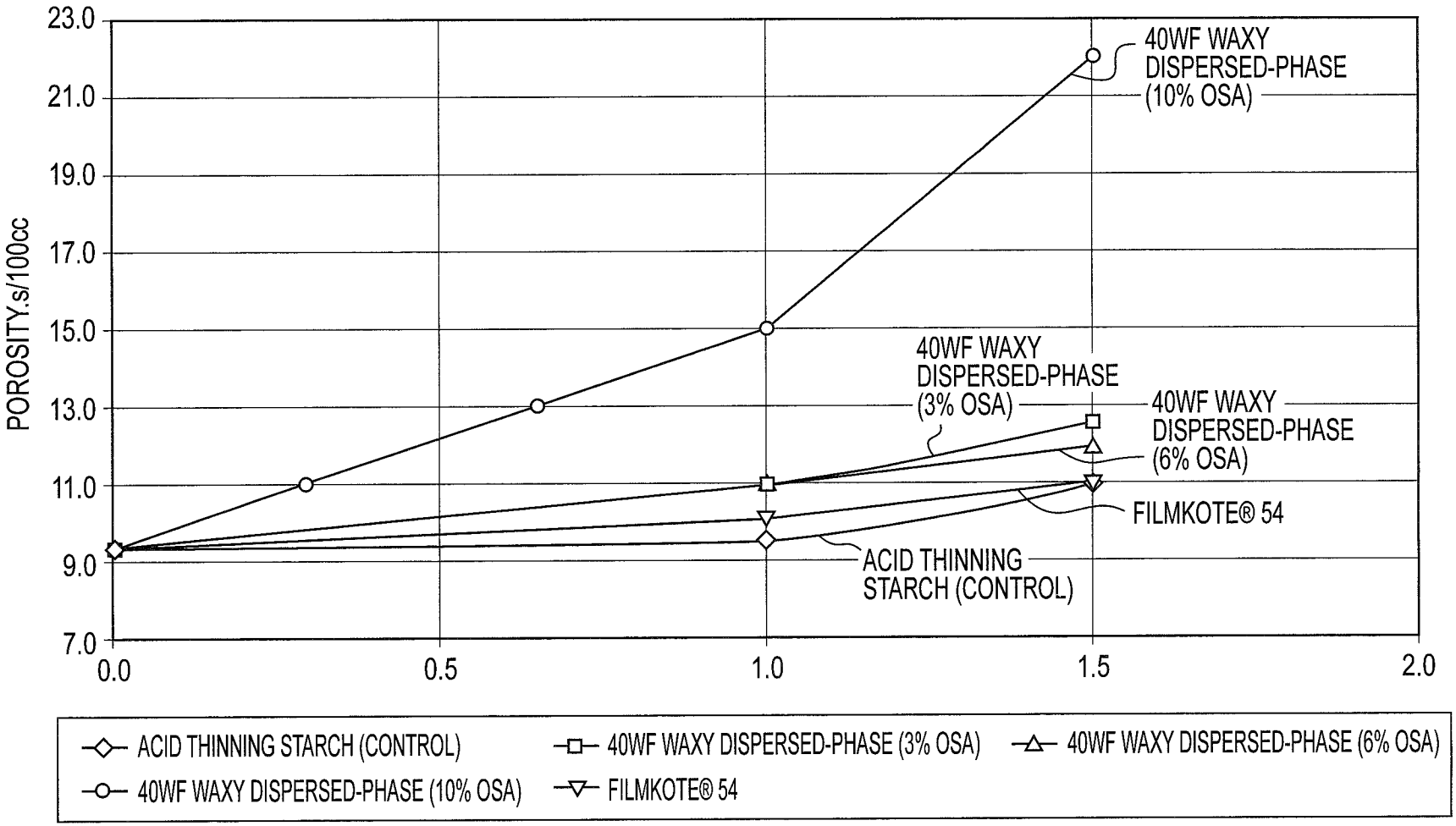
FIG. 1 depicts the porosity of 90 acid thinned tapoica:10 waxy corn degraded dispersed-phase derivatized starch with 10% OSA containing liquid natural polymer (based on dry: dry ratio).
Figure 1A:
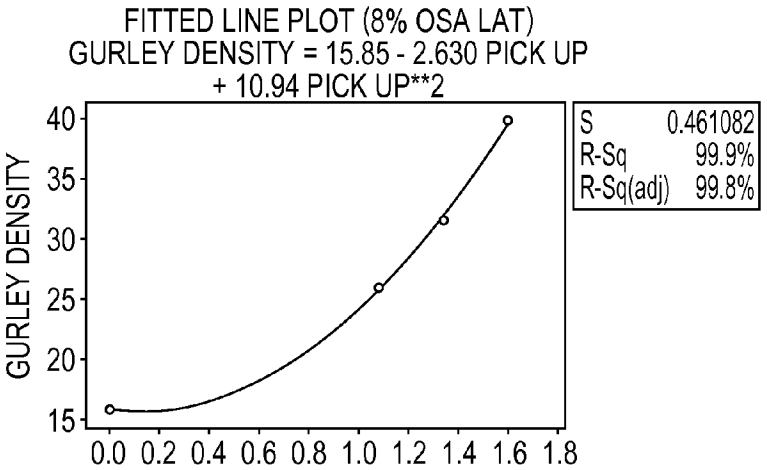
FIG. 1A depicts the fitted line plot of the Gurley density of 8% OSA dispersed-phase waxy corn starch.
Figure 1B:
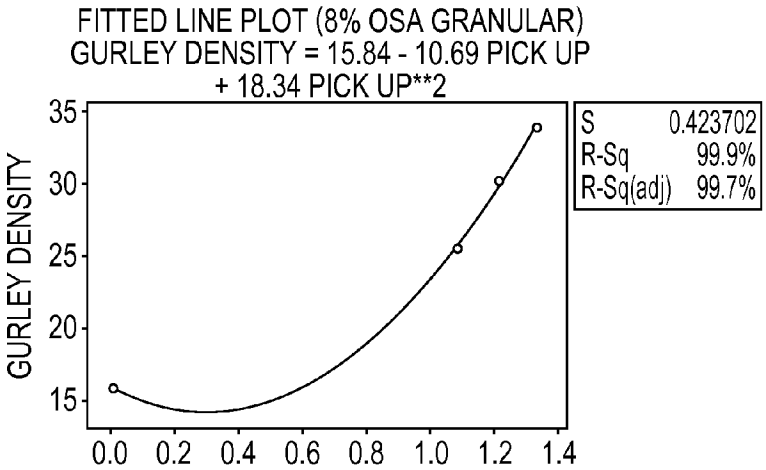
FIG. 1B depicts the fitted line plot of the Gurley density of 8% OSA granular waxy corn starch.
Figure 1C:
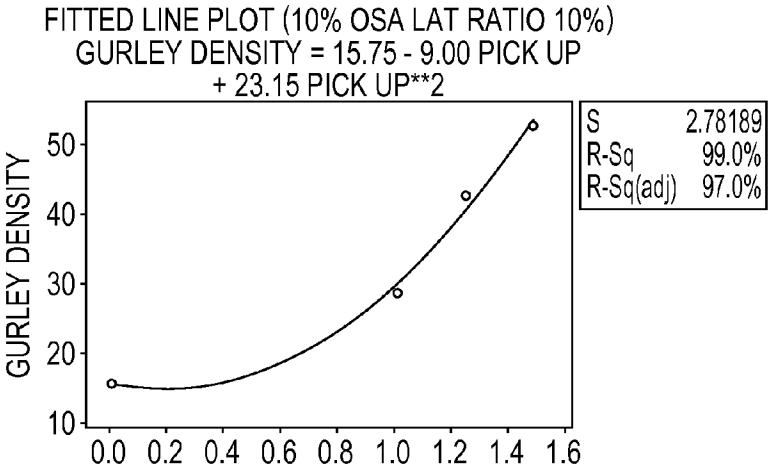
FIG. 1C depicts the fitted line plot of the Gurley density of 10% OSA dispersed-phase waxy corn starch.
Figure 1D:
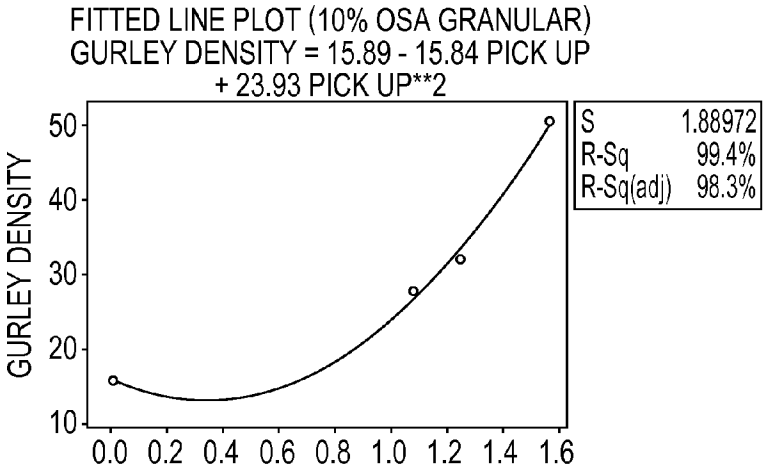
FIG. 1D depicts the fitted line plot of the Gurley density of 10% OSA granular waxy corn starch.
Figure 2A:
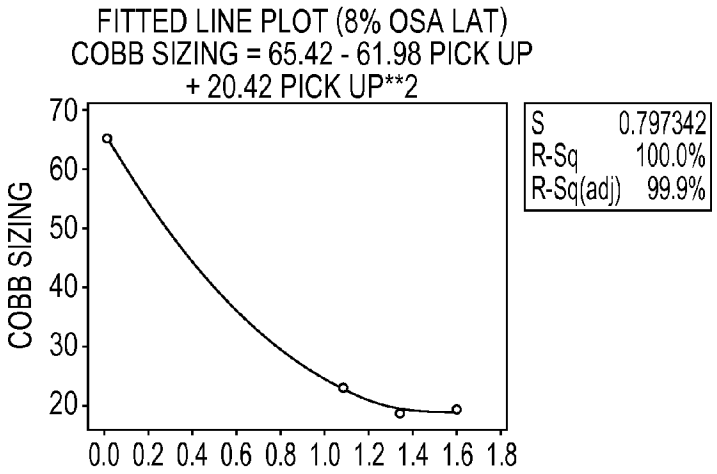
FIG. 2A depicts the fitted line plot of the Cobb sizing of 8% OSA dispersed-phase waxy corn starch.
Figure 2B:
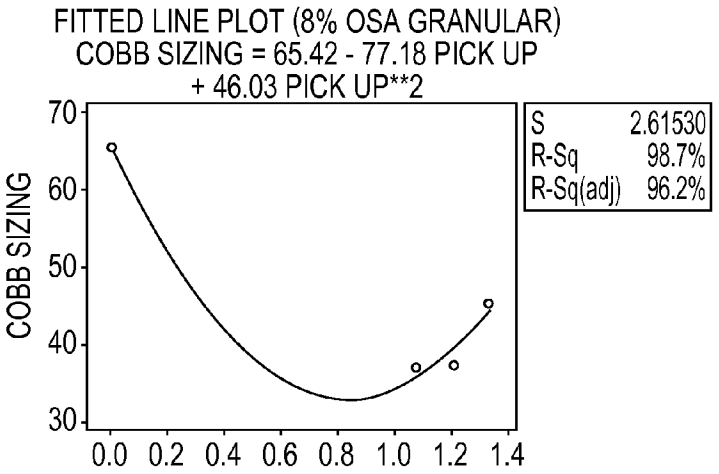
FIG. 2B depicts the fitted line plot of the Cobb sizing of 8% OSA granular waxy corn starch.
Figure 2C:
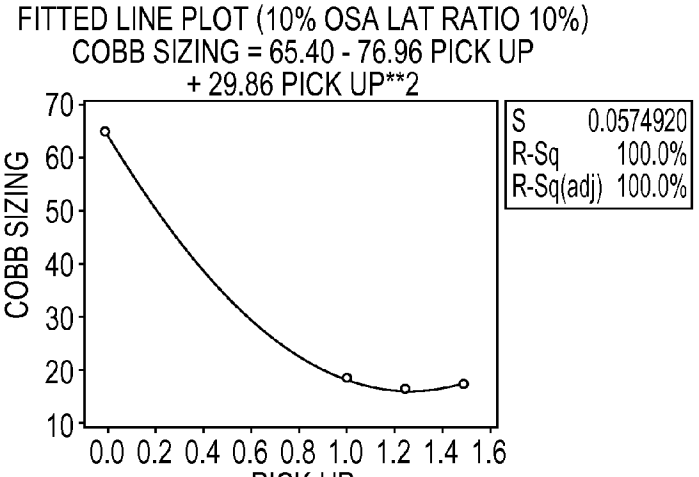
FIG. 2C depicts the fitted line plot of the Cobb sizing of 10% OSA dispersed-phase waxy corn starch.
Figure 2D:
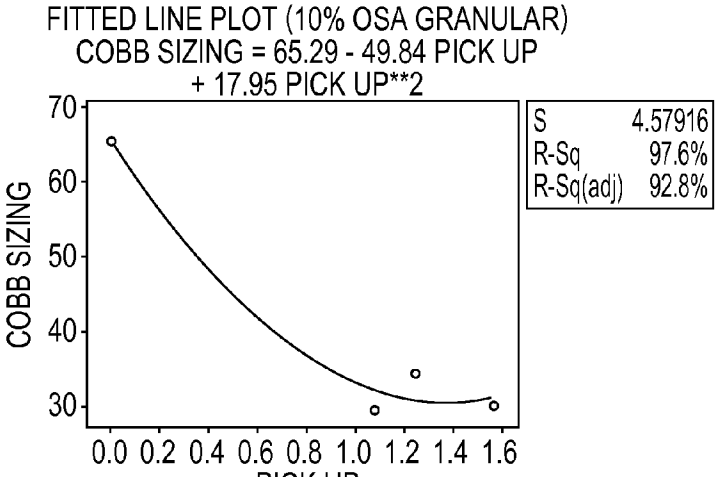
FIG. 2D depicts the fitted line plot of the Cobb sizing of 10% OSA granular waxy corn starch.
Figure 3A:
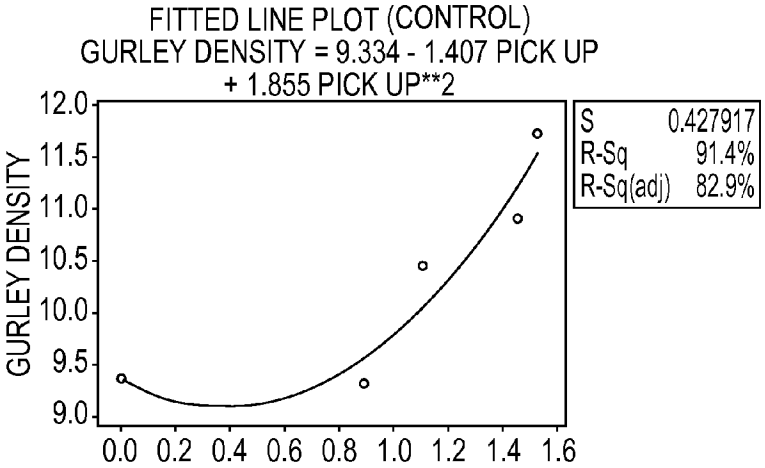
FIG. 3A depicts the fitted line plot of the Gurley density of 0% OSA (control) waxy corn starch.
Figure 3B:
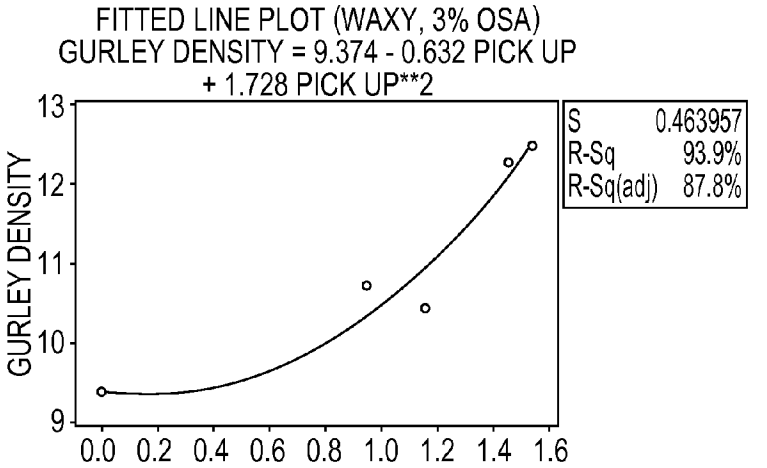
FIG. 3B depicts the fitted line plot of the Gurley density of 3% OSA dispersed-phase waxy corn starch.
Figure 3C:
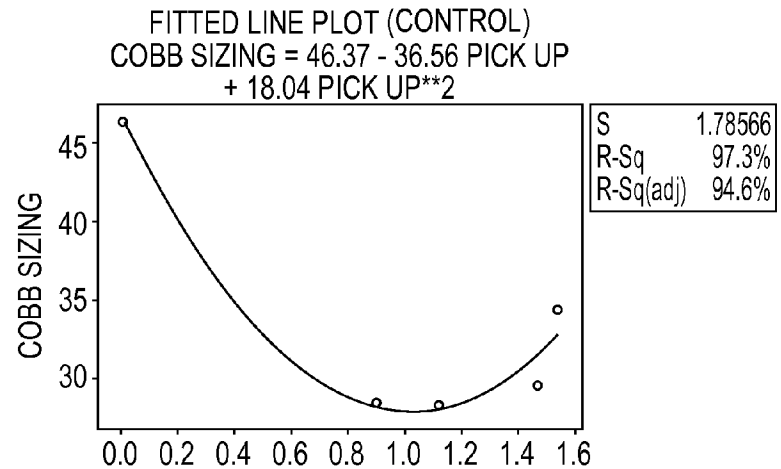
FIG. 3C depicts the fitted line plot of the Cobb sizing of 0% OSA (control) waxy corn starch.
Figure 3D:
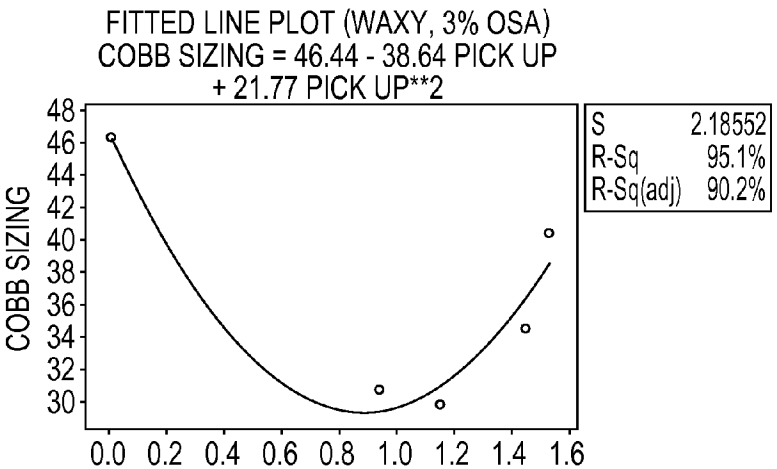
FIG. 3D depicts the fitted line plot of the Cobb sizing of 3% OSA dispersed-phase waxy corn starch.
Figure 4A:
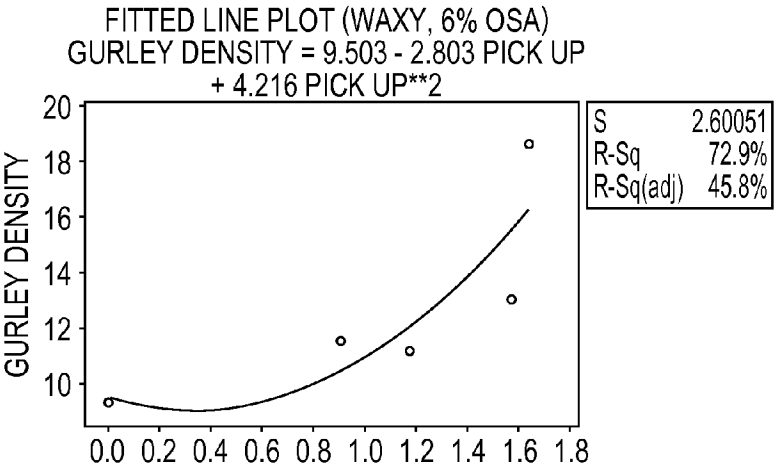
FIG. 4A depicts the fitted line plot of the Gurley density of 6% OSA dispersed-phase waxy corn starch.
Figure 4B:
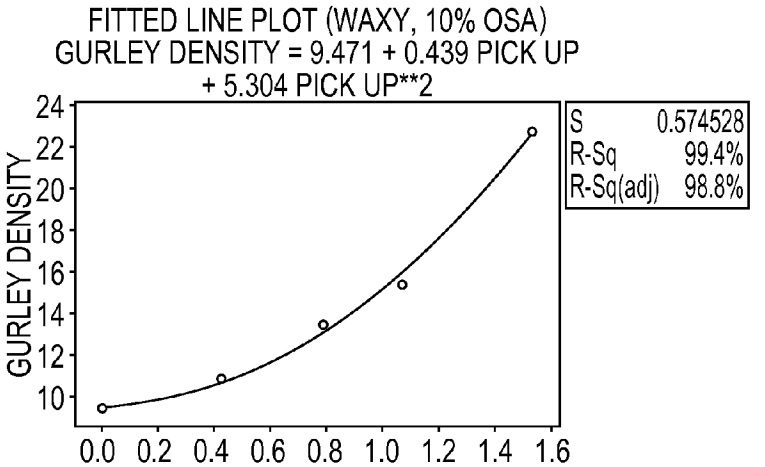
FIG. 4B depicts the fitted line plot of the Gurley density of 10% OSA dispersed-phase waxy corn starch.
Figure 4C:
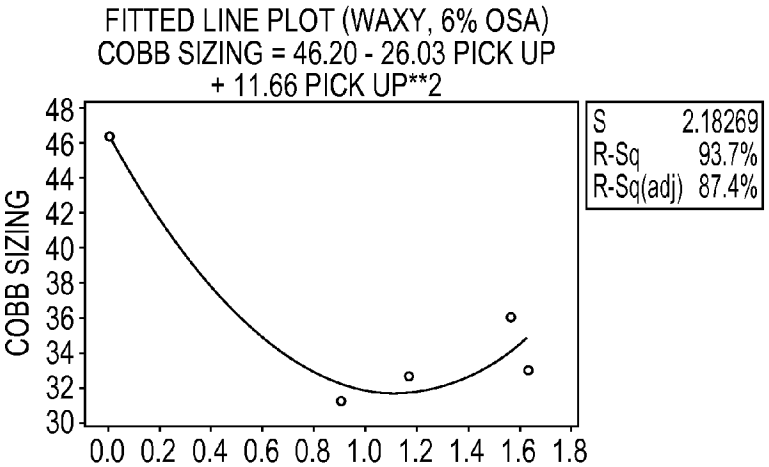
FIG. 4C depicts the fitted line plot of the Cobb sizing of 6% OSA dispersed-phase waxy corn starch.
Figure 4D:
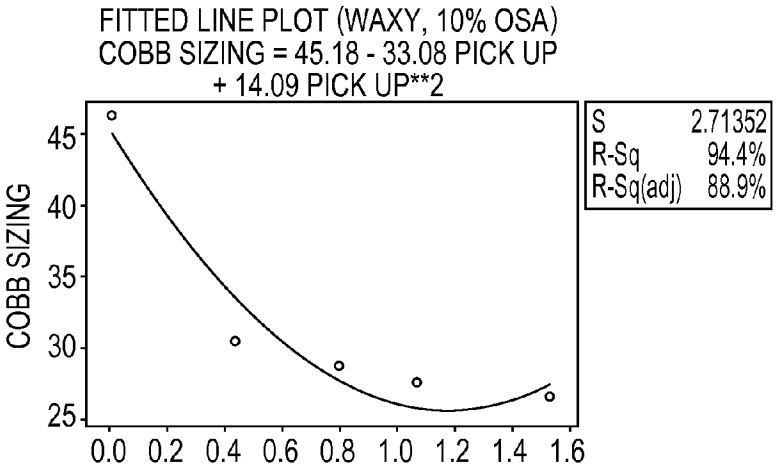
FIG. 4D depicts the fitted line plot of the Cobb sizing of 10% OSA dispersed-phase waxy corn starch.

In one aspect the application provides a process comprising:

a) slurrying a waxy starch and gelatinizing the slurry to a starch dispersion;
b) optionally cooling the starch dispersion;
c) optionally acidifying the optionally cooled starch dispersion and waiting until the optionally acidified starch dispersion reaches a funnel viscosity of from about 20 seconds to about 30 seconds;
d) reacting the optionally acidified starch dispersion from step c) with octenylsuccinic anhydride to prepare a reacted starch dispersion;
e) mixing the reacted starch dispersion with converted starch to prepare a starch mixture; and
f) applying the starch mixture to paper.

In one embodiment the application provides the process wherein the gelatinizing in step a) is by jet cooking.

In one embodiment the application provides the process wherein the solids level of the slurry of step a) is from about 20% (w/w) to about 40% (w/w) and the jet cooking temperature of step a) is from about 150° C. to about 165° C.

In one embodiment the application provides the process wherein the temperature of the starch dispersion in step b) is from about 50° C. to about 60° C.

In one embodiment the application provides the process wherein the pH of the cooled starch dispersion in step c) is from about 2.4 to about 3.9 and waiting until the optionally acidified starch dispersion reaches a funnel viscosity of from about 20 seconds to about 30 seconds.

In one embodiment the application provides the process wherein the starch dispersion from step c) reacts in step d) with from about 8% (w/w on a starch weight basis) to about 12% (w/w on a starch weight basis) octenylsuccinic anhydride at a pH of from about 6.5 to a pH of about 8.5.

In one embodiment the application provides the process wherein the reacted starch dispersion from step d) mixes in step e) with from about 8 parts (w/w on a starch weight basis) to about 10 parts (w/w on a starch weight basis) of about 85 water fluidity acid converted tapioca starch.

In one embodiment the application provides the process wherein a total solids level of the starch mixture in step f) is from 7% (w/w) to about 13% (w/w).

In one embodiment application provides the process comprising:

a) slurrying a waxy starch at a solids level of from about 20% (w/w) to about 40% (w/w) and jet cooking the slurry at a temperature of from about 150° C. to about 165° C. to prepare a starch dispersion;
b) cooling the starch dispersion to a temperature from about 50° C. to about 60° C.;
c) optionally acidifying the cooled starch dispersion to a pH of from about 2.4 to about 3.9 and waiting until the optionally acidified starch dispersion reaches a funnel viscosity of from about 20 seconds to about 30 seconds;

d) reacting the starch dispersion from step c) with from about 8% (w/w on a starch weight basis) to about 12% (w/w on a starch weight basis) octenylsuccinic anhydride at a pH of from about 6.5 to a pH of about 8.5 to prepare a reacted starch dispersion;

e) mixing the reacted starch dispersion with from about 8 parts (w/w on a starch weight basis) to about 10 parts (w/w on a starch weight basis) of about 85 water fluidity acid converted tapioca starch to prepare a starch mixture;

f) applying the starch mixture to paper at a total solids level of from 7% (w/w) to about 13% (w/w).

In one embodiment the application provides the process wherein the waxy starch of step a) is a maize or tapioca starch.

In one embodiment the application provides the process wherein the waxy starch of step a) is a maize starch.

In one embodiment the application provides the process wherein the waxy starch of step a) is a tapioca starch.

Native starch granules are insoluble in cold water. When native starch granules are dispersed in water and heated they become hydrated and swell. With continued heating, shear, or conditions of extreme pH, the granules fragment and the starch molecules are dispersed in the water, i.e., made soluble, resulting in a non-granular, dispersed starch. Trksak et al. in U.S. Pat. No. 7,829,600 B1 teaches the preparation of a 3% ("as-is" basis) octenyl succinic anhydride (OSA) dispersed-phase derivatized waxy corn and waxy potato starches. These starches had superior emulsifying properties compared to octenyl succinic anhydride derivatized starches made from granular starches.

Without being bound by theory, it is believed that a starch surface sizing made using a dispersed (cooked) starch reacted with octenyl succinic anhydride has a more uniform distribution of bound octenyl succinic anhydride groups than is possible on a granular starch after reaction of octenyl succinic anhydride. Current octenyl succinic anhydride-reacted and converted starch surface sizes (such as FILMKOTE® 54 starch) are not uniformly reacted with octenyl succinic anhydride, as the octenyl succinic anhydride will not react as rapidly with the crystalline regions of the starch granule. The reaction of octenyl succinic anhydride with granular starch results in a product that contains about 28% by weight of un-modified starch that is less effective as surface size than a similar molecular weight OSA-substituted dispersed-phase derivatized starch. Since the reaction of starch with octenyl succinic anhydride requires the emulsification of the octenyl succinic anhydride, the transfer of the OSA into the water phase, and absorption of the OSA from the water into the granular starch, a significant level of hydrolysis of the octenyl succinic anhydride occurs. This results in bound octenyl succinic anhydride levels normally between 2.2% and 2.6% from the allowed 3.3-3.4% treatment (based on dry starch weight and a 10-12% moisture starch). A reaction of octenyl succinic anhydride on a high solids cooked starch provides increased reaction efficiency, since the fully mobile, dispersed starch molecules are more accessible to the octenyl succinic anhydride.

The starch dispersion or cook is advantageously made by non-enzymatic methods of the hydrolysis of starch, such as acid conversion, Manox conversion or shear. These dispersion methods tend to create much less maltose and other low molecular weight oligosaccharides, whose presence greatly increases the likelihood of having starch molecules that are not substituted with octenyl succinic anhydride. Since octenyl succinic anhydride has a molecular weight of 210, this means that each starch molecule will have at least one bound octenyl succinic anhydride group if it has a molecular weight of 7981 or more (50+ anhydroglucose units), when treated with 3% octenyl succinic anhydride. In addition to a better control of molecular weight and uniformity of bound octenyl succinic anhydride distribution, a dispersed-phase octenyl succinic anhydride reaction provides higher octenyl succinic anhydride reaction efficiencies than is possible with the reaction of granular starch with octenyl succinic anhydride, leading to bound octenyl succinic anhydride levels above 3.0% with a 3% treatment (on 12% moisture starch). Because of these factors, a dispersed-phase octenyl succinic anhydride reaction on a converted starch produces a uniformly substituted starch that has a higher bound octenyl succinic anhydride level (due to the higher reaction efficiency of the dispersed-phase reaction), as well as improved surface sizing performance coming from the improved uniformity and higher bound octenyl succinic anhydride level.

Preparation of dispersed-phase derivatized starch by reaction of a fully dispersed, degraded base starch with octenyl succinic anhydride and blending this product as an additive to a low cost (commodity) surface sizing starch cook produces a paper sizing with superior properties. The base starch for the OSA reaction should have a suitable viscosity at ~30% solids and at 55° C., which are the OSA/starch reaction conditions. The final product blend may be a liquid natural polymer (LNP). Manufacturing costs are reduced compared to an OSA-reacted granular starch as the starch milk could be directly jet cooked, acid-converted in its dispersed state and reacted with OSA in a process that does not require washing or drying of the base.

DEFINITIONS

The following definitions and abbreviations are used in connection with the processes of the present application unless the context indicates otherwise. The phrase, "converted starch" means starch modified by chemical or physical means to rupture some or all of the starch molecules, weaken some of the granules, and decrease the average size of the starch molecules. A "converted starch" has a reduced viscosity. A "converted starch" can be used at higher concentration, has increased the water solubility, better gel strength, or increased stability. Methods of preparing "converted starch" are found in Wurzburg, O. B. "Converted Starches" in O. B. Wurzburg ed. *Modified Starches: Properties and Uses*, Boca Raton, Fla.: CRC Press, pages 17-29, 1986.

The word, "derivatize" means to alter a chemical compound by a chemical reaction with a reagent, such that it adds part or the entire reagent and becomes a derivative. The phrase "dispersed-phase derivatized starch" means starch, which in an at least 2 step process, is made sufficiently soluble; then, in the next or any subsequent process step, the starch made sufficiently soluble is derivatized.

FILMKOTE® is a registered trademark of Corn Products Development, Inc. for industrial starch for use in the manufacture of paper.

The term "funnel viscosity" means the results of a viscosity test, measured in seconds, whereby the flow rate of a specific volume of a starch dispersion is measured using a precisely defined glass funnel according to the procedure given in the Examples.

The term "gelatinizating" means a process to change starch and/or starch derivative from a slightly or completely loose granular or comparable granulate form into a form in which stretched starch and/or starch derivative chains are present and those chains are interconnected only slightly, if at all. That is to say, there occurs a transition of starch or starch derivative from a solid form, a colloidal solution, or suspension to a more homogeneous fluid mass. In this application, the term "gelatinizing" is synonymous to terms like "gelling", "gellating", or the like. Such processes are known in the art, for example in "Modified Starches: Properties and Uses", Ed. O. B. Wurzburg, CRC Press, Inc., Boca Raton, Fla. (1986), pages 10-13.

The phrase, "jet cooking" means providing efficient shearing and heating at 120-150° C. with direct steam and continuous flow of a material through a combining tube. In jet cooking, high pressure saturated steam, ranging from about 20 to about 200 psig, is injected through a steam nozzle into the center of a Venturi mixing tube. The slurry mass is pulled into the annulus gap formed by the steam nozzle and Venturi tube opening. The slurry is heated as it accelerates to sonic velocity within the mixing tube. During passage through the mixing tube, the fiber is subjected to extreme turbulence which strips off starch granule constituents and ultimately causes fracturing, dissociation, release of soluble biomolecules and refinement/cleansing of insoluble components of the fiber mosaic. Although "jet cooking" conditions may be widely varied by one skilled in the art, conditions are typically those cited in U.S. Pat. No. 8,252,322. Cooking conditions are in the range from about 130° C. to about 150° C. (20-50 psig) within the hydroheater portion of the cooker, with a steam line pressure of 65-70 psig entering the cooker. Steam pressure as the hot dispersion leaves the cooker results in an immediate temperature drop in the cooked dispersion to 100° C. The term "OSA" means octenyl succinic anhydride. Other anhydrides of succinic acids can also be used, such as succinic acid anhydride itself, alkylsuccinic acid anhydrides, or alkenylsuccinic acid anhydrides like decenyl succinic acid anhydride or octenyl succinic acid anhydride.

The phrase, "Manox conversion" means a process for degradation of granular starch, which involves hydrogen peroxide and a manganese salt catalyst such as potassium permanganate in alkaline slurry. Although "Manox conversion" conditions may be widely varied by one skilled in the art, conditions are typically those cited in U.S. Pat. No. 6,447,615.

The word "sizing" or "size" means a substance that is applied to or incorporated in other material, especially papers or textiles, to act as a protecting filler or glaze. The phrase "sizing agent" means a substance which adheres to substrate fibers and forms a film, with the hydrophilic tail facing the fiber and the hydrophobic tail facing outwards, resulting in a smooth finish that tends to be water-repellent.

The term "starch made sufficiently soluble" means starch that is substantially gelatinized so that the starch does not have a Maltese cross when viewed under polarized light and has lost all of its granular or crystalline structure when viewed microscopically at 100.times magnification. In a more specific embodiment, "starch made sufficiently soluble" means starch having an average particle size of less than one micron, as assessed by Polarization Intensity Differential Plus Elastic Light Scattering (Beckman Coulter LS 13 320 Aqueous Model).

The phrase "water fluidity" means a viscosity measured on a scale of 0 to 90 and determined according to the procedure given in the Examples.

The terms "waxy" or "low amylose" means a starch or starch-containing product (herein starch or starch-containing product shall be referred to as starch) containing less than 10% amylose by weight, in one embodiment less than 5% amylose, in another less than 2% amylose, and in yet another embodiment less than 1% amylose by weight of the starch.

The abbreviation "% (w/w)" or percentage weight to weight means concentrations of the ingredients given as a percentage of the weight of an ingredient in hundred weight units of total composition.

Certain specific aspects and embodiments of the present application will be explained in greater detail with reference to the following examples, which are provided only for purposes of illustration and should not be construed as limiting the scope of the application in any manner. Reasonable variations of the described procedures are intended to be within the scope of the present invention. While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

The following test procedures were used throughout the examples. Funnel Viscosity Measurement Procedure. The funnel viscosity is determined by adjusting the starch dispersion to be tested to 8.5% solids level (w/w), as measured by a refractometer. A 25 g portion of the starch dispersion (anhydrous basis) is weighed into a tarred 250 mL stainless steel beaker containing a thermometer and is brought to 200 g total weight with distilled water. The sample is mixed and cooled to 22° C. A total of 100 mL of the starch dispersion is measured into a graduated cylinder. The measured dispersion is then poured into a calibrated funnel while using a finger to close the orifice. A small amount of the dispersion is allowed to flow into the graduate to remove any trapped air, and the starch dispersion remaining in the graduated cylinder is poured back into the funnel. The finger is then removed from the orifice to allow the contents to flow out of the funnel and a timer is used to measure the time required for the 100 mL sample to flow through the apex (junction of the stem and funnel body) of the funnel. This time is recorded and is identified as the funnel viscosity, measured in seconds.

The glass portion of the funnel is a standard 58 degree cone angle, thick-wall, resistance glass funnel whose top diameter is from about 9 cm to about 10 cm with the inside diameter of the stem being about 0.381 cm. The glass stem of the funnel is cut to an approximate length of 2.86 cm from the apex, carefully fire-polished, and refitted with a long stainless steel tip which is about 5.08 cm long with an outside diameter of about 0.9525 cm. The interior diameter of the steel tip is about 0.5952 cm at the upper end where it is attached to the glass stem and about 0.4445 cm at the outflow end with the restriction in the width occurring at about 2.54 cm from the ends. The steel tip is attached to the glass funnel by means of a Teflon tube. The funnel is calibrated so as to allow 100 mL of water to go through in six seconds using the above procedure.

Air Resistance of Paper Measurement Procedure Gurley Density. The instrument is placed so that the outer cylinder is vertical. The outer cylinder is filled with sealing fluid to a depth of about 125 mm, as indicated by a ring on the inner surface of the cylinder. The inner cylinder is raised before inserting the specimen in the test clamp until its rim is supported by the catch. The specimen is clamped between the clamping plates. After the specimen is properly clamped, the inner cylinder is gently lowered until it floats. As the inner cylinder moves steadily downward, the number of seconds, to the nearest 0.1 second, required for the inner cylinder to descend from the 150 mL mark to the 250 mL mark, referenced to the rim of the outer cylinder is measured. Reference is made to Table 1 and Table 2 for the appropriate correction factors if displacement intervals other than the 150 mL to 250 mL marks are used. The measured time is multiplied by the correction factors from the appropriate table to obtain a corrected result for the alternate interval. If the correction factors are not used, the percentage error related to the measurement interval can be determined from the data in the tables.

TABLE 1

Correction factors for timing 100 mL indicated displacement

| Scale markers used | Correction factor (multiplier) |
|---|---|
| 0 to 100 mL | 1.017 |
| 50 to 150 mL | 1.011 |
| 100 to 200 mL | 1.006 |
| 150 to 250 mL | 1.000 |
| 200 to 300 mL | 0.994 |
| 250 to 350 mL | 0.988 |

TABLE 2

Correction factors for timing 50 mL indicated displacement

| Scale Markers Used | Correction factor (multiplier) |
|---|---|
| 0 to 50 mL | 2.040 |
| 50 to 100 mL | 2.029 |
| 100 to 150 mL | 2.017 |
| 150 to 200 mL | 2.006 |
| 200 to 250 mL | 1.994 |
| 250 to 300 mL | 1.982 |
| 300 to 350 mL | 1.970 |

Five specimens are tested with the top side up, and five specimens are tested with the top side down.

Water Absorptiveness of Sized Paper Measurement Cobb Test. The specimens are conditioned in an atmosphere in accordance with TAPPI T 402 "Standard Conditioning and Testing Atmospheres for Paper, Pulp Handsheets, and Related Products." Each specimen is weighted to the nearest 0.01 g. Half the specimens are tested with the wire side up, the other half with the felt side up. A dry rubber mat is placed on the metal plate and a weighed specimen laid on it. After wiping the metal ring perfectly dry, it is placed upon the specimen, and it is fasten firmly enough in place with the crossbar (or other clamping mechanism) to prevent any leakage between the ring and the specimen. For reporting, the test side is the one that is in contact with the water during the test. A 100 mL volume of water (23±1° C.) is poured into the ring as rapidly as possible to give a head of 1.0±0.1 cm (0.39 in.). The stopwatch is stared immediately. At 10±2 seconds before the expiration of the predetermined test period, the water is poured quickly from the ring, taking great care not to drop any of the water upon the outside portion of the specimen. The wing nuts (or other applicable clamping mechanism) is promptly loosened, the crossbar is swung out of the way while holding the ring in position by pressing it down with one hand. Carefully, but quickly, the ring is removed and the specimen is placed with its wetted side up on a sheet of blotting paper resting on a flat rigid surface. Exactly at the end of the predetermined test period, a second sheet of blotting paper is placed on top of the specimen and the surplus water is removed by moving the hand roller once back and once forward over the pad without exerting any additional pressure on the roller. Specimens which exhibit an excess of surplus water after blotting, as shown by glossy areas on the surface, are rejected and the test repeated. The specimen is folded with the wetted area inside. Immediately reweigh it to the nearest 0.01 g. The conditioned weight of the specimen is subtracted from its final weight, and is multiplied by 100 times the gain in weight in grams to obtain the weight of water absorbed in grams per square meter: weight of water, g/m$^2$=final weight, g−conditioned weight, g×100.

Water Fluidity Measurement Procedure. Water fluidity is measured using a Bohlin Visco 88 Rotational Viscometer with water jacket (commercially available from Malvern Instruments, Inc., Southborough, Mass.), standardized at 30° C. with a standard oil having a viscosity of 100.0 cps. The water fluidity is obtained by determining the viscosity at an 8.06% solids level and converting that viscosity to a water fluidity (WF) value using the equation below. The procedure involves adding the required amount of starch (e.g., 10.0 g. dry basis) to a stainless steel cup and adding 14 g. distilled water to make a paste. Then 100.00 grams of a 20% $CaCl_2$ solution is added to the cup and the mixture is heated in a 100° C. water bath for 30 minutes with rapid stirring for the first 2 minutes. The starch dispersion is then brought to the final weight (e.g. 124 g) with 90° C. or hotter distilled water. The sample is immediately transferred to the viscometer cup, which is then placed into the Bohlin Visco 88 unit and analyzed for its viscosity at 90° C. (after the unit is calibrated). The viscosity (in mPas) recorded by the Bohlin Visco 88 instrument is converted to a water fluidity number as defined by the following equation: (water fluidity=116.0=[18.746×Ln(viscosity)]), wherein Ln is the natural logarithm.

Example 1

Preparation of a Degraded Dispersed-Phase Modified Octenyl Succinic Anhydride Waxy Corn Starch Sample E792:81 was prepared by first slurrying waxy maize starch at 30% solids in tap water. This pH 7.7 slurry was then was jet cooked at approximately 149° C., resulting in a jet cooked starch dispersion with a dry solids of about 24%. A 7000 g portion of the jet cooked waxy maize starch dispersion was placed in a constant temperature bath and maintained at 89° C. with constant stifling. Concentrated HCl (2.16 g) was added to the jet cook starch slurry to drop the pH to 2.93. After 90 minutes, the funnel viscosity was determined to be 24 seconds. The pH was then adjusted to 7.5 with 3% NaOH, the temperature adjusted to 55° C., and 3% octenyl succinic anhydride was added on starch weight basis ("starch weight" is defined as the weight of starch present, assuming a 12% moisture level of the starch). The pH was maintained at 7.5 for 2 hours and then the pH was adjusted to 5.4 with dilute HCL. A 1% level (on starch weight basis) of a preservative was then added to the dispersion. This process was repeated, with samples being made that were acid-degraded to a 24 second funnel viscosity and then reacted with 6% and 10% octenyl succinic anhydride (E792:82 and E792:83).

Example 2

Preparation of a Degraded Dispersed-Phase Modified Octenyl Succinic Anhydride Tapioca Starch Sample E792:84 was prepared by first slurrying tapioca starch at 30% solids in tap water. This pH 7.8 slurry was then was jet cooked at approximately 149° C., resulting in a jet cooked starch dispersion with a dry solids of about 21%. A 7000 g portion of the jet cooked waxy maize starch dispersion was placed in a constant temperature bath and maintained at 85° C. with constant stifling. Concentrated HCl (1.70 g) was added to the jet cook to drop the pH to 2.96. After 120 minutes, the funnel viscosity was determined to be 24 seconds. The pH was then adjusted to 7.5 with 3% NaOH, the temperature adjusted to 90° C. and 3% octenyl succinic anhydride was added on starch weight ("starch weight" is defined as the weight of starch present, assuming a 12% moisture level of the starch). The pH was maintained at 7.5 for 2 hours and then the pH was neutralized to 4.77 with dilute HCl. A 1% level (on starch weight basis) of a preservative was then added to the dispersion. This process was repeated, with samples being made that were second funnel viscosity and then reacted with 6% and 10% octenyl succinic anhydride (E792: 85) and E:792:86).

Example 3

Preparation of a Control Octenyl Succinic Anhydride Waxy Corn Modified in the Granular State Sample E792: 131-1 was prepared by slurrying 2000 g of an acid degraded waxy maize starch at in 3000 g of tap water. The funnel viscosity (measured on a jet cook of this starch as per Example 1) was found to be 20 seconds. The pH of this slurry then adjusted to 7.5 with 3% NaOH solution and 10% octenyl succinic anhydride was added on starch weight ("starch weight" is defined as the weight of starch present, assuming a 12% moisture level of the starch). The pH was maintained at 7.5 for 4 hours and then the pH was adjusted to 5.4 with dilute HCl. The slurry was then filtered and the collected starch dried.

Example 4

Paper Surface Sizing Evaluation of Dispersed-Phase Modified Octenyl Succinic Anhydride Starches A surface sizing application test was performed using a laboratory coating unit from Sumet Measurement Technology (Hauser Strasse 3-5, 86971 Peiting., Germany). The coating unit consisted of a single motorized rubber-coated cylinder that was arranged in the format of a horizontal size press where the paper is fed between a flat rubber coated board and the motorized rubber-coated cylinder. The coating pan on the laboratory coater was preheated to 50° C. and a jet-cooked, acid thinned, starch control (approximately 6 seconds funnel viscosity) was kept at 5° C. using a water bath before addition into the lab coater. All starch cooks were evaluated at 8%, 10%, or 12% solids and 50° C., in order to vary their pickup levels on the paper. The octenyl succinic anhydride-modified starches were blended with the acid-thinned control starch at a weight ratio of 90:10 (acid-thinned starch:octenyl succinic anhydride starch) and mixed for 5 minutes using a motorized stirrer at 400 rpm before evaluation. The acid-thinned control starch was evaluated without blending at 8%, 10%, or 12% solids.

A 297 mm×210 mm sheet of 79 g/m$^2$ paper base stock was pre-weighed after conditioning in a 25° C. and 70% relative humidity room. The motorized rubber-coated cylinder was set to a 15 meters/min. speed. A sample of 50° C. starch was poured into the coating pan and the thickness of starch on the motorized rubber-coated cylinder was controlled via a pressure regulating rod set to 20 Newtons. The paper sheet was held on the flat rubber coated board and fed between the motorized rubber-coated cylinder and another non-motorized rubber coated cylinder. A cylinder pressure of 100 Newtons was applied on the non-motorized rubber coated cylinder. After the stock paper was passed through the cylinders, primary drying was done immediately with an online infra-red heater set at 100%. Secondary drying was subsequently done on the mirror-faced surface of a Formax drum dryer (Adirondack Machine Corporation, 181 Dixon Road, Queensbury, N.Y. 12804 USA) set to 60 rpm at 80° C. The sheets were then re-conditioned in a 25° C. and 70% relative humidity room and weighed again to determine the amount of surface-size starch (the percentage pickup in g/m$^2$) that was applied on the sheet. These sheets were then tested for their air permeability (porosity) using Gurley density tester. This unit develops porosity values according to a TAPPI Standard Method (T460 om-96, air resistance of paper (Gurley method), TAPPI Press, Atlanta, Ga.). The porosity values in Table 1 are the times (average of 2 sheets) required for 100 cm$^3$ of air to flow through a 6.4 cm$^2$ area of the sheet. The values were then plotted and a software package (Mini Tab) was used to fit a line to the data to allow estimation of Gurley density values at a 1.0 g/m$^2$ and 1.5 g/m$^2$ pickup for each additive.

TABLE 1

| Additive OSA starches were blended at a 10:90 ratio with the acid thinned tapioca control | % of 85 water fluidity tapioca control @ 1.5 g/m$^2$ pickup | seconds Gurley density @ 1.0 g/m$^2$ pickup | seconds Gurley density @ 1.5 g/m$^2$ pickup |
|---|---|---|---|
| acid thinned tapioca control | 100 | 9.78 | 11.40 |
| **FILMKOTE ® 54 starch (granular waxy 3% OSA) | 164 | 12.01 | 18.69 |
| FILMKOTE ® 54 starch (granular waxy 3% OSA) | 107 | 9.98 | 12.22 |
| E792:81 (dispersed waxy 3% OSA) | 108 | 10.47 | 12.31 |
| E792:82 (dispersed waxy 6% OSA) | 130 | 10.92 | 14.78 |
| **FILMKOTE ® 340 starch (granular tapioca 3% OSA) | 155 | 12.16 | 22.06 |
| FILMKOTE ® 340 starch (granular tapioca 3% OSA) | 102 | 1092 | 17.70 |
| E792:84 (dispersed tapioca 3% OSA) | 111 | 11.22 | 11.57 |
| E792:85 (dispersed tapioca 6% OSA) | 126 | 11.63 | 12.63 |
| E792:86 (dispersed tapioca 10% OSA) | 138 | 13.43 | 14.31 |
| **FILMKOTE ® 340 starch (granular tapioca 3% OSA) | 155 | 12.16 | 15.73 |

**Referred to 100% granular starch without mixing with acid thinned tapioca Reaction of 10% octenyl succinic anhydride onto dispersed, degraded tapioca or waxy maize starch provided significant improvements in the paper's Gurley density when added at a 10% level on an acid thinned tapioca and used to surface size paper.

Reaction of 10% octenyl succinic anhydride onto dispersed, degraded tapioca or waxy maize starch provided significant improvements in the paper's Gurley density when added at a 10% level on an acid thinned tapioca and used to surface size paper.

Example 5

Paper Surface Sizing Comparison of Dispersed-Phase Modified Octenyl Succinic Anhydride Starches with Granular Reacted Equivalents An additional a jet cooked starch dispersion with a funnel viscosity of 24 seconds (E792: 133-1) was prepared as per Example 1. This was reacted with 8% octenyl succinic anhydride on starch weight basis. In a similar manner, an additional control octenyl succinic anhydride waxy corn starch (E792:143-1), modified with 8% octenyl succinic anhydride (on starch weight basis) in the granular state, was made as per Example 3. These were evaluated as per Example 4 except that a 78 g/m$^2$, non-surfaced fine paper base stock was used. These sheets were also tested for sizing according to a TAPPI Standard Method (T441 om-98, "Water Absorptiveness of Sized (Non-bibulous) Paper, Paperboard, and Corrugated Fiberboard" (Cobb test), TAPPI Press, Atlanta, Ga.). Results are listed in Tables 2 and 3. The Gurley density or Cobb values were plotted against their g/m$^2$ pickups and values at 1.0 g/m$^2$ and 1.5 g/m$^2$ were estimated by the same procedure used in Example 4.

TABLE 2

| Additive OSA starches were blended at a 10:90 ratio with the acid thinned tapioca control | % of 85 water fluidity tapioca control @ 1.5 g/m$^2$ pickup | Seconds Gurley density @ 1.0 g/m$^2$ pickup | Seconds Gurley density @ 1.5 g/m$^2$ pickup |
|---|---|---|---|
| acid thinned tapioca control | 100 | 17.28 | 18.02 |
| E792:133-1 (dispersed waxy 8% OSA) | 203 | 24.16 | 36.52 |
| E792:143-1 (granular waxy 8% OSA type) | 228 | 23.49 | 41.07 |
| E792:83 (dispersed waxy 10% OSA) | 302 | 29.90 | 54.34 |
| E792:133-1 (granular waxy 10% OSA type) | 255 | 23.98 | 45.97 |

TABLE 3

| Additive OSA starches were blended at various ratios with the acid thinned tapioca control | % of 85 water fluidity tapioca control @ 1.5 g/m$^2$ pickup | Seconds Gurley density @ 1.0 g/m$^2$ pickup | Seconds Gurley density @ 1.5 g/m$^2$ pickup |
|---|---|---|---|
| acid thinned tapioca control | 100 | 62.37 | 65.16 |
| E792:133-1 (dispersed waxy 8% OSA) | 28 | 23.86 | 18.40 |
| E792:143-1 (granular waxy 8% OSA type) | 82 | 34.27 | 53.21 |
| E792:83 (dispersed waxy 10% OSA) | 26 | 18.30 | 17.14 |
| E792:133-1 (granular waxy 10% OSA type) | 47 | 33.43 | 30.92 |

While the 90:10 blend of 8% octenyl succinic anhydride granular surface size gave Gurley density values (higher is better) that were 203% of the 85 water fluidity tapioca control, the equivalent blend of the dispersed-phase 8% octenyl succinic anhydride surface size gave 228% (12% better). Increasing the octenyl succinic anhydride to 10% increased these values to 302% and 255%, with the dispersed-phase octenyl succinic anhydride reaction being 18% better than the granular octenyl succinic anhydride reaction product. Cobb sizing (lower values are better) improved even more. The 90:10 blend of 8% octenyl succinic anhydride granular surface size gave 122% of the 85 water fluidity tapioca control (i.e. 82% of the water pickup of the control). The equivalent blend of the dispersed-phase 8% octenyl succinic anhydride surface size gave 357% of the control (only 34% of the water pickup of its granular equivalent). Increasing the octenyl succinic anhydride to 10% increased these values to 212% and 384% of the control, with the dispersed-phase octenyl succinic anhydride reaction allowing only 55% of the water pickup of its granular equivalent. The dispersed-phase octenyl succinic anhydride product exhibited significantly lower Cobb pickups and higher Gurley density values than the equivalent granular product.

Example 6

Paper Surface Sizing of Dispersed-Phase Modified Octenyl Succinic Anhydride Starches at Varying Ratios on Acid Thinned Tapioca The 10% octenyl succinic anhydride dispersed-Phase modified starch was also evaluated at 85:15 and 95:5 ratios (blended with the acid-thinned control starch). These were evaluated as per Example 4, except that a 78 g/m$^2$, non-surface sized fine paper base stock was used. Results are listed in Tables 4 and 5. The measured properties (Gurley density or Cobb sizing) was plotted against the g/m$^2$ pickup and values interpolated at 1.0 g/m$^2$ and 1.5 g/m$^2$ pickups for each additive by the method given in Example 4.

TABLE 4

| Additive OSA starches were blended at various ratios with the acid thinned tapioca control | % of 85 water fluidity tapioca control @ 1.5 g/m$^2$ pickup | ratio acid thinned tapioca:OSA starch | seconds Gurley density @ 1.0 g/m$^2$ pickup | seconds Gurley density @ 1.5 g/m$^2$ pickup |
|---|---|---|---|---|
| acid thinned tapioca control | 100 | n/a | 17.28 | 18.02 |
| E792:83 (dispersed waxy 10% OSA) | 159 | 95:5 | 19.64 | 28.66 |
| E792:83 (dispersed waxy 10% OSA) | 302 | 90:10 | 29.90 | 54.34 |
| E792:83 (dispersed waxy 10% OSA) | 369 | 85:15 | 40.69 | 66.43 |
| E792:143-1 (granular waxy 10% OSA) | 255 | 90:10 | 23.98 | 45.97 |

Increasing the amount of dispersed-phase octenyl succinic anhydride product on 85 water fluidity tapioca increased Gurley density values from 159% of the 85 water fluidity tapioca control at a 5% add-on to 369% at a 15% add-on. The values for a 90:10 blend of the granular 10% octenyl succinic anhydride type are shown for comparison.

TABLE 5

| Additive OSA starches were blended at various ratios with the acid thinned tapioca control | % of 85 water fluidity tapioca control @ 1.5 g/m$^2$ pickup | ratio acid thinned tapioca:OSA starch | Cobb sizing @ 1.0 g/m$^2$ pickup | Cobb sizing @ 1.5 g/m$^2$ pickup |
|---|---|---|---|---|
| acid thinned tapioca control | 100 | n/a | 62.37 | 65.16 |
| E792:83 (dispersed waxy 10% OSA) | 50 | 95:5 | 40.53 | 32.58 |
| E792:83 (dispersed waxy 10% OSA) | 26 | 90:10 | 18.30 | 17.14 |
| E792:83 (dispersed waxy 10% OSA) | 21 | 85:15 | 15.84 | 13.98 |
| E792:143-1 (granular waxy 10% OSA) | 47 | 90:10 | 33.43 | 30.92 |

Cobb sizing improved in a similar manner. With a 5% add-on of the 10% octenyl succinic anhydride dispersed-phase surface size, the Cobb sizing was improved by 100% compared to the 85 water fluidity tapioca control. Increasing this to 10% and 15% improved Cobb by 385% and 476% respectively. Even a 5% add-on of the dispersed-phase 10% octenyl succinic anhydride product exhibited not only a 59% higher Gurley density value, but a 50% lower Cobb pickup than the control. Its Cobb value was similar at the 5% add-on to a 10% add-on of the 10% octenyl succinic anhydride granular product.

Example 7

Preparation of a Degraded Dispersed-Phase Modified Octenyl Succinic Anhydride Waxy Corn Starch This was prepared by slurrying waxy corn starch at 30% solids, and jet cooking this slurry at 157° C. The cooked starch (about 26% solids), was allowed to cool to 55° C. Hydrochloric acid (0.09% on starch cook, pH 2.93) was added and the viscosity tracked for 90 minutes until an 8.5% funnel viscosity time of 24 seconds was observed. The starch cook was then adjusted to pH 7.5, 10% octenyl succinic anhydride (on starch weight basis) was added, and 1024 g of 25% NaOH solution was used to maintain the pH at 7.5 until the pH was stable (about 4 hours). The bound OSA content was 6.71%.

The reaction mixture was then added at a 10% level to a jet cooked, 85 water fluidity, acid converted, tapioca starch and used to surface size paper at 3 different total solids levels (8%, 10%, 12%) at 50° C. to vary the amount of starch applied to the paper. At a starch pickup level of 1.5 g/m$^2$, a low pressure Gurley density porosity reading of 22 seconds was obtained, which is twice that of the jet cooked, 85 water fluidity, acid converted, tapioca starch alone. Under the same reaction conditions and starch application level, a 3% OSA reaction on a similar viscosity granular base waxy starch (FILMKOTE® 54 starch, 2.6% bound OSA) gave only a 19.5 seconds Gurley density reading.

Thus, the dispersed-phase derivatized starch with 10% OSA containing liquid natural polymer was over 10 times as effective as the comparable granular reaction product, while it contained only about 2.5 times the bound OSA. When added at a 10% level onto the 85 water fluidity tapioca starch, FILMKOTE® 54 starch gave no liquid natural polymer improvement at a 1.5 g/m$^2$ pickup (see FIG. 1).

Example 8

Comparison of Paper Surface Sizing of Dispersed-Phase Modified Octenyl Succinic Anhydride Waxy Corn Starch with Granular Reacted Equivalents A jet cooked starch dispersion with a funnel viscosity of 24 seconds was prepared as per Example 1. This was reacted with either 8% or 10% octenyl succinic anhydride (on starch weight basis). In a similar manner, control octenyl succinic anhydride waxy corn starch, modified with either 8% or 10% octenyl succinic anhydride (on starch weight basis) in the granular state, was made as per Example 3. All starch cooks were evaluated at 8%, 10%, or 12% solids in order to vary their pickup levels on the paper. The octenyl succinic anhydride-modified starches were blended with the acid-thinned tapioca starch at a weight ratio of 90:10 (acid-thinned starch: octenyl succinic anhydride starch) and mixed for 5 minutes using a motorized stirrer at 400 rpm before evaluation. These were evaluated as per Example 4 except that a 78 g/m$^2$, non-surface-sized fine paper base stock was used. Results are listed in Table 6. The measured properties (Gurley density or Cobb sizing) were plotted against the g/m$^2$ pickup and values interpolated at 1.0 g/m$^2$ and 1.5 g/m$^2$ pickups for each additive by the method given in Example 4. The comparison of the sizing properties of the dispersed-Phase modified and granular reacted acid-thinned tapioca starch:octenyl succinic anhydride starch blend is given in Table 6.

TABLE 6

| OSA loading of waxy corn starch | percentage improvement of dispersed-phase derivatized starch to granular starch Gurley density @ 1.0 g/m$^2$ pickup | percentage improvements of dispersed-phase derivatized starch to granular starch Gurley density @ 1.5 g/m$^2$ pickup | percentage improvement of dispersed-phase derivatized starch to granular starch Cobb sizing @ 1.0 g/m$^2$ pickup | percentage improvement of dispersed-phase derivatized starch to granular starch Cobb sizing @ 1.5 g/m$^2$ pickup |
|---|---|---|---|---|
| 8% | 3% | −12% | 44% | 189% |
| 10% | 20% | 15% | 83% | 80% |

The raw data for the Gurley density measurements are given in Table 7. In the Gurley density test, a higher value is better.

TABLE 7

| sample | % OSA treatment | seconds Gurley density @ 1.0 g/m$^2$ pickup | seconds Gurley density @ 1.5 g/m$^2$ pickup | difference in seconds between 1.0 g/m$^2$ pickup blend and tapioca starch control | difference in seconds between 1.5 g/m$^2$ pickup blend and tapioca starch control | % difference between 1.0 g/m$^2$ pickup blend and tapioca starch control | % difference between 1.5 g/m$^2$ pickup blend and tapioca starch control | difference in seconds between dispersed-phase blend and granular blend @ 1.0 g/m$^2$ pickup | difference in seconds between dispersed-phase blend and granular blend @ 1.5 g/m$^2$ pickup |
|---|---|---|---|---|---|---|---|---|---|
| dispersed-phase | 8 | 24.16 | 36.52 | 6.88 | 18.50 | 40 | 103 | 0.67 | −4.55 |

TABLE 7-continued

| sample | % OSA treatment | seconds Gurley density @ 1.0 g/m$^2$ pickup | seconds Gurley density @ 1.5 g/m$^2$ pickup | difference in seconds between 1.0 g/m$^2$ pickup blend and tapioca starch control | difference in seconds between 1.5 g/m$^2$ pickup blend and tapioca starch control | % difference between 1.0 g/m$^2$ pickup blend and tapioca starch control | % difference between 1.5 g/m$^2$ pickup blend and tapioca starch control | difference in seconds between dispersed-phase blend and granular blend @ 1.0 g/m$^2$ pickup | difference in seconds between dispersed-phase blend and granular blend @ 1.5 g/m$^2$ pickup |
|---|---|---|---|---|---|---|---|---|---|
| granular | 8 | 23.49 | 41.07 | 6.21 | 23.05 | 36 | 128 | | |
| dispersed-phase | 10 | 29.90 | 54.34 | 12.62 | 36.32 | 73 | 202 | 5.92 | 8.37 |
| granular | 10 | 23.98 | 45.97 | 6.70 | 27.95 | 39 | 155 | | |

The raw data for the Cobb water absorption measurements are given in Table 8. In the Cobb water absorption test, a lower value is better.

TABLE 8

| sample | % OSA treatment | Cobb water absorption @ 1.0 g/m$^2$ pickup | Cobb water absorption @ 1.5 g/m$^2$ pickup | difference in Cobb between 1.0 g/m$^2$ pickup blend and tapioca starch control | difference in Cobb between 1.5 g/m$^2$ pickup blend and tapioca starch control | % difference between 1.0 g/m$^2$ pickup blend and tapioca starch control | % difference between 1.5 g/m$^2$ pickup blend and tapioca starch control | difference in Cobb between dispersed-phase blend and granular blend @ 1.0 g/m$^2$ pickup | difference in Cobb between dispersed-phase blend and granular blend @ 1.5 g/m$^2$ pickup |
|---|---|---|---|---|---|---|---|---|---|
| dispersed-phase | 8 | 23.86 | 18.40 | 38.51 | 46.76 | −62 | −72 | −10.41 | −34.81 |
| granular | 8 | 34.27 | 53.21 | 28.10 | 11.95 | −45 | −18 | | |
| dispersed-phase | 10 | 18.30 | 17.14 | 44.07 | 48.02 | −71 | −74 | −15.13 | −13.78 |
| granular | 10 | 33.43 | 30.92 | 28.94 | 34.24 | −46 | −53 | | |

Example 9

Comparison of Paper Surface Sizing of Dispersed-Phase Modified Octenyl Succinic Anhydride Waxy Corn Starch at Different OSA Loadings A jet cooked starch dispersion with a funnel viscosity of 24 seconds was prepared as per Example 1. This was reacted with 3%, 6%, or 10% octenyl succinic anhydride on starch weight. All starch cooks were evaluated at 8%, 10%, or 12% solids in order to vary their pickup levels on the paper. The octenyl succinic anhydride-modified starches were blended with the acid-thinned tapioca starch at a weight ratio of 90:10 (acid-thinned starch:octenyl succinic anhydride starch) and mixed for 5 minutes using a motorized stirrer at 400 rpm before evaluation. These were evaluated as per Example 4, except that a 78 g/m$^2$, non-surface-sized fine paper base stock was used. Results are listed in Table 9. The measured properties (Gurley density or Cobb sizing) were plotted against the g/m$^2$ pickup and values interpolated at 1.0 g/m$^2$ and 1.5 g/m$^2$ pickups for each additive by the method given in Example 4. The comparison of the sizing properties of the dispersed-Phase modified and granular reacted acid-thinned tapioca starch:octenyl succinic anhydride starch blend is given in Table 9 along with the results from a non-blended acid-thinned tapioca starch control.

TABLE 9

| OSA loading of waxy corn starch | percentage improvement of dispersed-phase derivatized starch to granular starch Gurley density @ 1.0 g/m$^2$ pickup | percentage improvements of dispersed-phase derivatized starch to granular starch Gurley density @ 1.5 g/m$^2$ pickup | percentage improvement of dispersed-phase derivatized starch to granular starch Cobb sizing @ 1.0 g/m$^2$ pickup | percentage improvement of dispersed-phase derivatized starch to granular starch Cobb sizing @ 1.5 g/m$^2$ pickup |
|---|---|---|---|---|
| 3% | 7% | 9% | 15% | 13% |
| 6% | 12% | 35% | 19% | 30% |
| 10% | 56% | 109% | 37% | 44% |

Example 10

Comparison of Paper Surface Sizing of Dispersed-Phase Modified Octenyl Succinic Anhydride Waxy Corn Starch at Different Blend Ratios A dispersed-phase modified 10% octenyl succinic anhydride starch was prepared as per Example 9. All starch cooks were evaluated at 8%, 10%, or 12% solids in order to vary their pickup levels on the paper. The octenyl succinic anhydride-modified starch was blended with the acid-thinned tapioca starch at a weight ratios of 95:5, 90:10, and 85:15 (acid-thinned starch:octenyl succinic anhydride starch) and mixed for 5 minutes using a motorized stirrer at 400 rpm before evaluation. These were evaluated as per Example 4 except that a 78 g/m$^2$, non-surface-sized fine paper base stock was used. Results are listed in Table 10. The measured properties (Gurley density or Cobb sizing) were plotted against the g/m$^2$ pickup and values interpolated at 1.0 g/m$^2$ and 1.5 g/m$^2$ pick-ups for each blend by the method given in Example 4. The comparison of the sizing properties of the acid-thinned tapioca starch:dispersed-phase modified octenyl succinic anhydride starch blend is given in Table 10 along with the results from a non-blended acid-thinned tapioca starch control.

TABLE 10

| acid-thinned tapioca starch:dispersed-phase modified OSA starch ratio | percentage improvement of dispersed-phase derivatized starch to granular starch Gurley density @ 1.0 g/m$^2$ pickup | percentage improvements of dispersed-phase derivatized starch to granular starch Gurley density @ 1.5 g/m$^2$ pickup | percentage improvement of dispersed-phase derivatized starch to granular starch Cobb sizing @ 1.0 g/m$^2$ pickup | percentage improvement of dispersed-phase derivatized starch to granular starch Cobb sizing @ 1.5 g/m$^2$ pickup |
|---|---|---|---|---|
| 95:5 | 14% | 63% | 35% | 50% |
| 90:10 | 20% | 199% | 71% | 74% |
| 85:15 | 38% | 273% | 75% | 79% |

The more dispersed-phase modified 10% octenyl succinic anhydride starch used to make the sizing blend, the better the performance in the standard paper sizing assays.

Throughout this application, various publications are referenced. The disclosures of these publications in their entireties are hereby incorporated by reference into this application in order to more fully describe the state of the art as known to those skilled therein as of the date of the application described and claimed herein. While particular embodiments of the present application have been illustrated and described, it would be obvious to those skilled in the art that various other changes and modifications can be made without departing from the spirit and scope of the application. It is therefore intended to cover in the appended claims all such changes and modifications that are within the scope of this application.

What is claimed is:

1. A process of sizing paper comprising applying an aqueous starch mixture to paper, said aqueous starch mixture being comprised of a mixture of a converted starch and a dispersion of a reacted starch, the mixture of converted starch and dispersion of reacted starch being the product of process steps comprised of:

a) slurrying in water a waxy starch and gelatinizing the slurry to prepare a starch dispersion;

b) optionally acidifying the starch dispersion to prepare an optionally acidified starch dispersion and optionally waiting until the optionally acidified starch dispersion reaches a funnel viscosity of from about 20 seconds to about 30 seconds;

c) reacting the starch of the optionally acidified starch dispersion from step b) with at least about 3% (w/w on a starch weight basis) of octenylsuccinic anhydride to prepare a dispersion a reacted starch; and d) mixing the reacted starch dispersion with a dispersion or cook of converted starch.

2. The process of claim 1 wherein the gelatinizing in step a) is by jet cooking.

3. The process of claim 1 wherein the solids level of the starch dispersion of step a) is from about 20% (w/w) to about 40% (w/w) and the temperature of the starch dispersion during the gelatinizing of step a) is from about 150-° C. to about 165-° C.

4. The process of claim 1 wherein the process of preparing the starch mixture is further comprised of cooling the starch dispersion to a temperature of about 50° C. to about 60-° C. immediately after the gelatinizing of the starch slurry.

5. The process of claim 1 wherein the pH of the optionally acidified starch dispersion in step b) is from about 2.4 to about 3.9.

6. The process of claim 1 wherein the starch of the optionally acidified starch dispersion from step b) reacts in step c) with from about 8% (w/w on a starch weight basis) to about 12% (w/w on a starch weight basis) octenylsuccinic anhydride at a pH of from about 6.5 to a pH of about 8.5.

7. The process of claim 1 wherein one part of the dispersion of reacted starch from step c) mixes in step d) with from about 8 parts (w/w on a starch weight basis) to about 10 parts (w/w on a starch weight basis) of about 85 water fluidity acid converted tapioca starch.

8. The process of claim 1 wherein a total solids level of the aqueous starch mixture is from 7% (w/w) to about 13% (w/w).

9. The process of claim 1 wherein the weight of octenylsuccinic anhydride of step c) is greater than 3% by weight of the starch of the optionally acidified starch dispersion.

10. The process of claim 1 wherein the starch of the optionally acidified starch dispersion from step b) reacts in step c) with from just greater than 3% (w/w on a starch weight basis) to about 12% (w/w on a starch weight basis) octenylsuccinic anhydride at a pH of from about 6.5 to a pH of about 8.5.

11. A process of sizing paper comprising applying an aqueous starch mixture to paper, said aqueous starch mixture being a mixture of a converted starch and a dispersion of reacted starch, said mixture of converted starch and dispersion of reacted starch being at a total solids level of from 7% (w/w) to about 13% (w/w), prepared by process steps comprised of:

a) slurrying in water a waxy starch at a solids level of from about 20% (w/w) to about 40% (w/w) and jet cooking the slurry at a temperature of from about 150-° C. to about 185-° C. to prepare a starch dispersion;

b) cooling the starch dispersion to a temperature from about 50-° C. to about 60-° C. to prepare a cooled starch dispersion;

c) optionally acidifying the cooled starch dispersion to a pH of from about 2.4 to about 3.9 to prepare an optionally acidified starch dispersion and optionally waiting until the optionally acidified starch dispersion reaches a funnel viscosity of from about 20 seconds to about 30 seconds;

d) reacting the starch of the optionally acidified starch dispersion from step c) with from about 8% (w/w on a starch weight basis) to about 12% (w/w on a starch weight basis) octenylsuccinic anhydride at a pH of from about 6.5 to a pH of about 8.5 to prepare a dispersion of reacted starch; and e) mixing one part by weight of the dispersion of reacted starch with from about 8 parts (w/w on a starch weight basis) to about 10 parts (w/w on a starch weight basis) of about 85 water fluidity acid converted tapioca starch.

12. The process of claim 11 wherein one part of the dispersion of reacted starch from step d) mixes in step e) with from about 8 parts (w/w on a starch weight basis) to about 10 parts (w/w on a starch weight basis) of about 85 water fluidity acid converted tapioca starch.

13. A process of sizing paper comprising applying an aqueous starch mixture to paper, said aqueous starch mixture being comprised of a mixture of a converted starch and a dispersion of a reacted starch, the mixture of converted starch and dispersion of reacted starch being the product of process steps comprised of:

a) slurrying in water a waxy starch and gelatinizing the slurry to prepare a starch dispersion;

b) acidifying the starch dispersion to prepare an acidified starch dispersion and then waiting until the acidified starch dispersion reaches a funnel viscosity of from about 20 seconds to about 30 seconds;

c) reacting the starch of the acidified starch dispersion from step b) with from just greater than 3% to about 12% (w/w on a starch weight basis) of octenylsuccinic anhydride to prepare a dispersion of reacted starch; and d) mixing one part by weight of the dispersion of reacted starch with from about 8 parts (w/w on a starch weight basis) to about 10 parts (w/w on a starch weight basis) of the converted starch to prepare the aqueous starch mixture.

* * * * *